United States Patent [19]

Peterman

[11] Patent Number: 4,708,411

[45] Date of Patent: Nov. 24, 1987

[54] ANTI TIP SYSTEM

[75] Inventor: Robert J. Peterman, Hartland, Wis.

[73] Assignee: Spacesaver Corporation, Fort Atkinson, Wis.

[21] Appl. No.: 923,275

[22] Filed: Oct. 27, 1986

[51] Int. Cl.[4] ..... A47B 53/00

[52] U.S. Cl. ..... 312/201; 104/251; 104/248; 312/198; 312/333

[58] Field of Search ..... 104/248, 242, 254, 258, 104/249, 250, 251; 312/198, 201, 250, 301, 333; 70/90, 85, 86

[56] References Cited

U.S. PATENT DOCUMENTS

| | | | |
|---|---|---|---|
| T978,006 | 1/1979 | Carman et al. | 292/D46 |
| 1,171,801 | 2/1916 | Osherhont | 104/251 |
| 1,713,459 | 5/1929 | Withyman | 104/248 |
| 1,940,971 | 12/1933 | Schwartz et al. | 292/D46 |
| 4,607,896 | 8/1986 | Peterman | 312/201 |

FOREIGN PATENT DOCUMENTS

| | | | |
|---|---|---|---|
| 0641124 | 5/1962 | Canada | 104/254 |

*Primary Examiner*—Kenneth J. Dorner
*Assistant Examiner*—Gerald Anderson
*Attorney, Agent, or Firm*—Fuller, Puerner & Hohenfeldt

[57] ABSTRACT

A mobile storage system has improved safety features on the movable carriages. The safety features include an anti tip mechanism having dual plate for cooperating with respective channels fastened to the rails. The dual plates and channel design prevents disengagement of the plates from the channels if a carriage should lurch to one side. An adjustable safety stop limits carriage end travel to selected locations along the rails. A locking mechanism temporarily locks the carriages in desired locations. The locking mechanism includes a rack that is adjustably positionable along the rails and that is also reversible to meet any locking requirement.

5 Claims, 7 Drawing Figures

ANTI TIP SYSTEM

BACKGROUND OF THE INVENTION

1. Field of the Invention

This invention pertains to safety devices, and more particularly to apparatus for enhancing the safety of mobile storage systems.

2. Description of the Prior Art.

Mobile storage systems are well known. They are becoming increasingly popular in offices, factories, and warehouses because of their ability to store large quantities of materials in a minimum amount of space.

The design of a mobile storage system involves several safety considerations. A characteristic of the system movable carriages is that they normally are quite high and long in relation to their widths in the direction of travel along the system rails. Consequently, a top loaded carriage may be relatively unstable and prone to tipping in the directions of motion.

Carriage anti tip devices are known, such as the device disclosed in co-pending U.S. patent application Ser. No. 694,847 now U.S. Pat. No. 4,618,197. Although the prior anti tip devices are generally satisfactory, under certain operating conditions it is possible for a moving carriage to lurch to one side of the rails such that the anti tip device becomes disengaged. Further, prior anti tip devices having components fixedly mounted to the carriages require component assembly to the carriages prior to assembly of the carriage to the rails. Consequently, the carriages must be assembled to the rails by sliding the carriages along the rails from one end, which is an inefficient operation.

It is also known to employ end stops attached to the mobile storage system rails for limiting carriage travel along the rails. U.S. patent application Ser. No. 766,249 illustrates exemplary carriage stops. Prior stops, however, are fixed to the rails to permanently limit the end position of the carriages. Changing the travel limits to suit subsequent system modifications is therefore a costly and time consuming operation.

Another significant safety aspect of mobile storage systems is the temporary locking of the carriages in place on the rails. Ability to lock the carriages in selected places is important for the safety of persons in the aisles between adjacent carriages. Locking ability is also desirable for retaining a carriage in one location for extended periods of loading or unloading the shelves. A prior locking device is disclosed in U.S. patent application Ser. No. 575,216 now U.S. Pat. No. 4,607,896. Although that device has enjoyed commercial success, it is somewhat more expensive than desired.

Thus, a need exists for improved safety features on mobile storage systems.

SUMMARY OF THE INVENTION

In accordance with the present invention, devices in the form of an anti tip mechanism, an adjustable end stop, and a carriage locking device are provided that increase the safety of mobile storage systems. This is accomplished by apparatus that includes combinations of cooperating fixed and movable members arranged to prevent undesired relative motion between the system carriages and the surrounding environment.

The anti tip mechanism comprises a pair of allochiral plates mounted to the carriages. A plate horizontal leg rides within a channel mounted to the insides of the carriage rails. The spacings between the plate horizontal legs and the associated channels are designed to prevent disengagement of the plates and channels should the carriage lurch and tend to derail. The plates are mounted to the carriages by means of tabs and fasteners after the carriages are set in place on the rails. Accordingly, the carriages may be set on the rails from above and need not be slid on the rails from one end.

Further in accordance with the present invention, the carriage end stop is adjustable longitudinally along the rails. For that purpose, the end stop comprises a block designed to slide between the anti tip mechanism channel and a rail. The adjustable block is used in combination with washers in a design that rigidly grips the block to the anti tip mechanism channel at the desired location. The block is positioned on the channel so as to be contacted by the anti tip mechanism plate and thereby prevent carriage movement past the block. To cushion the carriage plate when striking the stop block, a resilient bumper may be secured to the block at the point of plate contact.

In the preferred embodiment, the present invention includes a rugged but simple device that temporarily locks the carriage in desired locations along the rails. The locking device includes a rack releasably fastened to the anti tip mechanism channel. A vertically reciprocable lock post selectively engages and disengages the rack to prevent or permit longitudinal movement of the carriage along the rails. A link bar is employed to positively withdraw the lock bar from the rack. Link bar operation is accomplished by means of a manually operated key lock located at about waist level. Gravity forces the lock post into engagement with the rack. The rack teeth are designed to permit carriage motion in one direction when the key lock is operated to the locked mode. In a modified embodiment of the present invention, the key lock is located only a few inches above the rails. In that design, the lock post is operated directly by the key lock mechanism without requiring the long link bar. To enhance the versatility of the present invention, the rack is adjustable longitudinally along the rails, and it is also reversible. Accordingly, the locking device can meet any locking requirement.

Other objects, aims, and advantageous of the invention will become apparent upon reading the detailed description.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
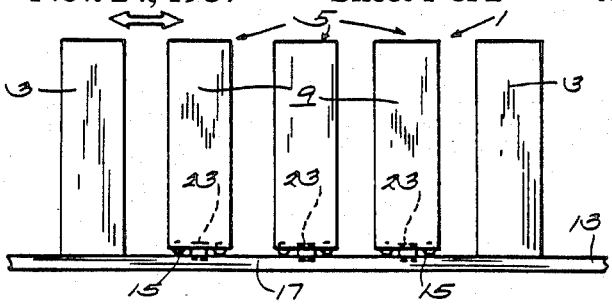
FIG. 1 is a side view of a typical mobile storage system that includes the present invention.

Referring to FIG. 1, a mobile storage system 1 is illustrated that includes the present invention. The mobile storage system is particularly useful for storing books, records, and supplies in offices and libraries. However, it will be understood that the invention is not limited to storage applications.

Figure 2:
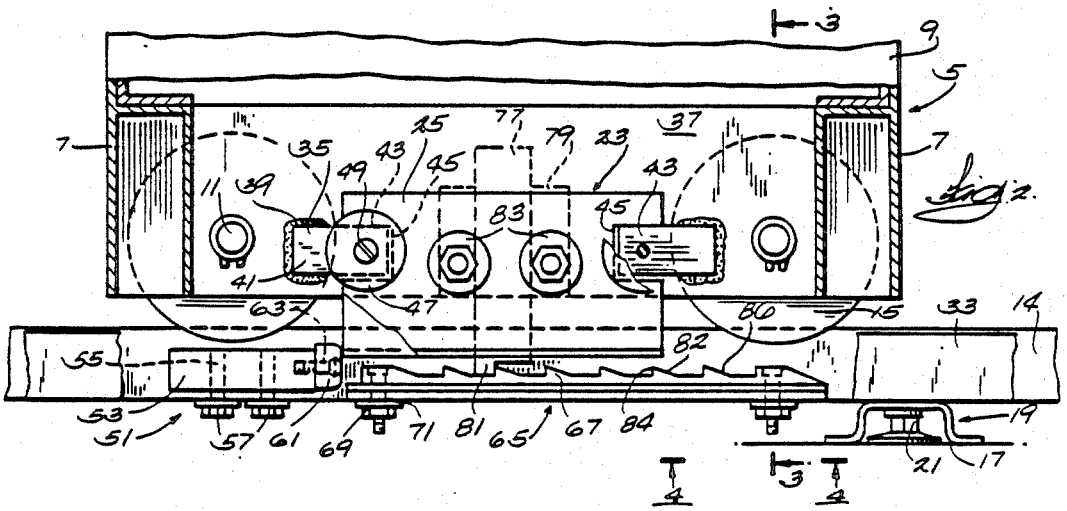
FIG. 2 is an enlarged side view, partially in section, of the lower portion of a movable carriage of the mobile storage system of FIG. 1.

The mobile storage system 1 typically includes one or more stationary storage units 3 in combination with movable carriages 5. The carriages 5 comprise a frame 7 that supports relatively high upright panels and interconnected shelving 9, as is known in the art. See FIGS. 2 and 3. Mounted to the carriage frames 7 are pairs of axles 11. The carriages are movable longitudinally in the direction of arrow 12 along parallel rails 13 and 14 by means of pairs of wheels 15 that are mounted to the respective axles 11. The panels and shelves 9 are narrow in the longitudinal directions 12 relative to the shelving height. The rails 13 and 14 may be supported on the building floor 17 by modular frames 19, such as those disclosed in copending U.S. patent application Ser. No. 766,249. Adjusting screws 21 are used in conjunction with the modular frames 19 to level the rails.

Figure 3:
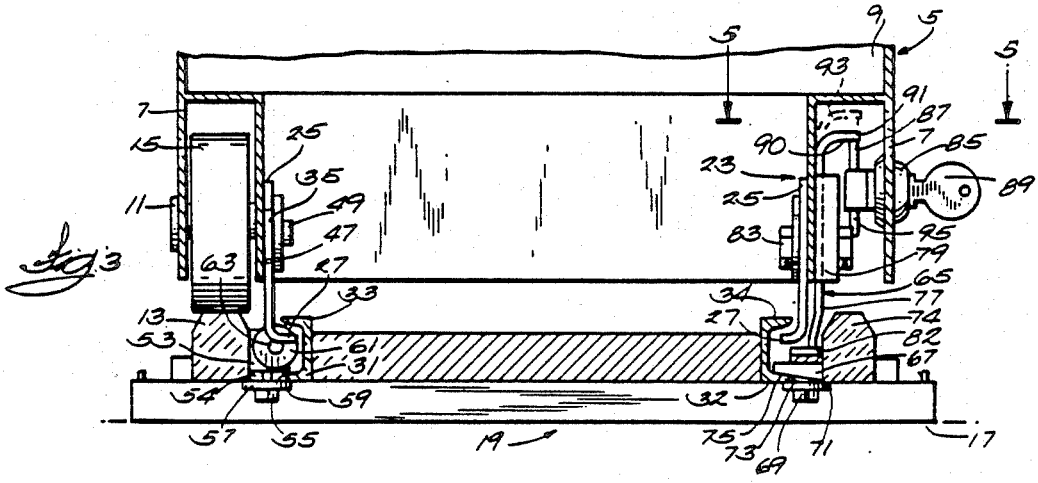
FIG. 3 is a cross-sectional view taken along lines 3—3 of FIG. 2.
Figure 5:
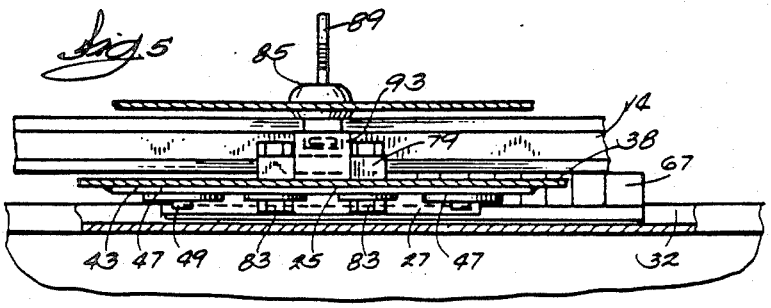
FIG. 5 is a cross-sectional view taken along lines 5—5 of FIG. 3.

In accordance with the present invention, each movable carriage 5 is provided with a safety anti tip mechanism 23. The anti tip mechanism 23 is highly desirable for preventing an eccentrically loaded top heavy carriage from tipping in the longitudinal direction 12. In the illustrated construction, the anti tip mechanism comprises a pair of vertically oriented allochiral plates 25 having horizontal in-turned legs 27. The legs 27 extend within the areas 29 defined by oppositely facing channels 31 and 32. The channels 31 and 32 are firmly attached to the rail frames 19 by conventional fasteners, not shown. As best seen in FIG. 3, the plate legs 27 are positioned relatively close to the channel upper legs 33 and 34.

To guide the anti tip plates 25 on the carriage frame 7, a pair of generally rectangular tabs 35 are provided that interfit with the plates. The tabs 35 are welded or otherwise secured to the carriage frame members 37 and 38 only on and adjacent the tab outer ends 41. Consequently, the tab inner ends 43 are suited to receive notches 45 formed in the anti tip plates. To secure the plates to the tabs 35, large washers 47 in combination conventional fasteners 49 are employed. With the anti tip mechanism 23 of the present invention in place, a carriage 5 cannot lurch to one side and disengage the plates from the channels 31 and 32.

A further advantage of the present invention is that the tabs 35 can be welded to the frame members 37 and 38 before the carriage 5 is set in place on the rails 13 and 14. As a result, a partially assembled carriage can be place on the rails from above, and the plates 25 can be assembled to the carriage after the carriage has been placed on the rails. The tab and notch design of the present invention is thus an improvement over prior constructions in which the anti tip mechanisms were completely assembled to the carriages before the carriages were placed on the rails, thereby requiring that the carriages be slid longitudinally on the rails from end.

Further in accordance with the present invention, movement of the carriages 5 along the rails 13 and 14 is limited by at least one adjustable stop 51. The adjustable stop 51 includes a block 53 that is placed between the rail 13 and the channel 31, as is best shown in FIG. 3. Screws 55 extend downwardly from the block 53 into the slot 54 between the rail and channel. A large washer 57 is used with each screw 55. The washers 57 are placed against the under surfaces of the rail and channel. Tightening the screws squeezes the channel lower leg 59 between the washers 57 and block to secure the block at the desired location along the rails. The block is dimensioned such that it is in the path of the anti tip mechanism plate 25. Consequently, the block limits carriage longitudinal travel. To cushion the contact between the anti tip plate and the block, a resilient bumper 61 may be fastened to the block operative end by any suitable means, such as a screw 63. To change the location of the positive stop 51, the screws 55 are merely loosened. They are slid along the slot 54, together with the washers and block, to the new location. Retightening the screws secures the stop at the desired location.

Figure 4:
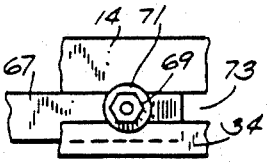
FIG. 4 is a view taken along lines 4—4 of FIG. 2.

Pursuant to the present invention, provision is made for temporarily locking a movable carriage 5 at any location along the rails 13 and 14. Temporary locking is accomplished by means of a locking mechanism 65 that includes a rack 67. The rack 67 is adjustably secured to the rail 14 and channel 34 at any desired location. Rack securement and adjustability are provided by screws and nuts 69 in combination with washers 71. The screws extend into slot 73 between the rail 14 and channel 34. See FIG. 4. Tightening the screws 69 squeezes the channel lower leg 75 between the rack and washers 71 and secures the rack in place. Loosening the screws enables them to be slid within the slot 73, together with the rack and washers, to a desired new location for securement. The versatility of the present invention is demonstrated by the fact that the rack can be reversed endwise between the rail 14 and channel 34, so that the present invention can accommodate all locking needs.

To engage the rack 67 for locking the carriage 5 a lock post 77 reciprocates vertically within a slotted guide block 79. The guide block 79 is mounted to the outside of the carriage frame member 38 by means of fasteners 83. The lower end of the lock post 77 is formed with a stub end 81 that engages the rack teeth 82. The rack teeth 82 are formed with straight sides 84 and ramp sides 86.

To reciprocate the lock post 77 within the guide block 79, a key lock 85 is used. The key lock 85 includes an upper pin 87 that extends from and retracts into the key lock under the control of a key 89. The pin 87 contacts the under surface 90 of a bent-over upper leg 91 of the lock post. Operating the key 89 to extend the pin 87 from the key lock causes the pin to raise the lock post to the position shown by the phantom lines 93 in FIG. 3. The key lock and pin thus disengage the stub end 81 from the rack teeth 82 and thereby permit carriage movement along the rails. Operating the key to retract the pin into the key lock causes gravity to pull the lock post downwardly so that the stub end engages the rack. Because the lock post is not positively retained in contact with the rack, the carriage is capable of being moved in one direction with the key lock operated to the locked mode. Such motion is possible toward the left in FIGS. 2 and 6 because of the design of the rack teeth 82. The lock post can ride up the teeth ramps sides 86, but subsequent movement to the right is prevented by engagement between the lock post and the rack teeth straight sides 84. If the rack is reversed on the floor panels 19, the direction of carriage movement and locking with the key lock in the operative mode are also reversed.

Figure 6:
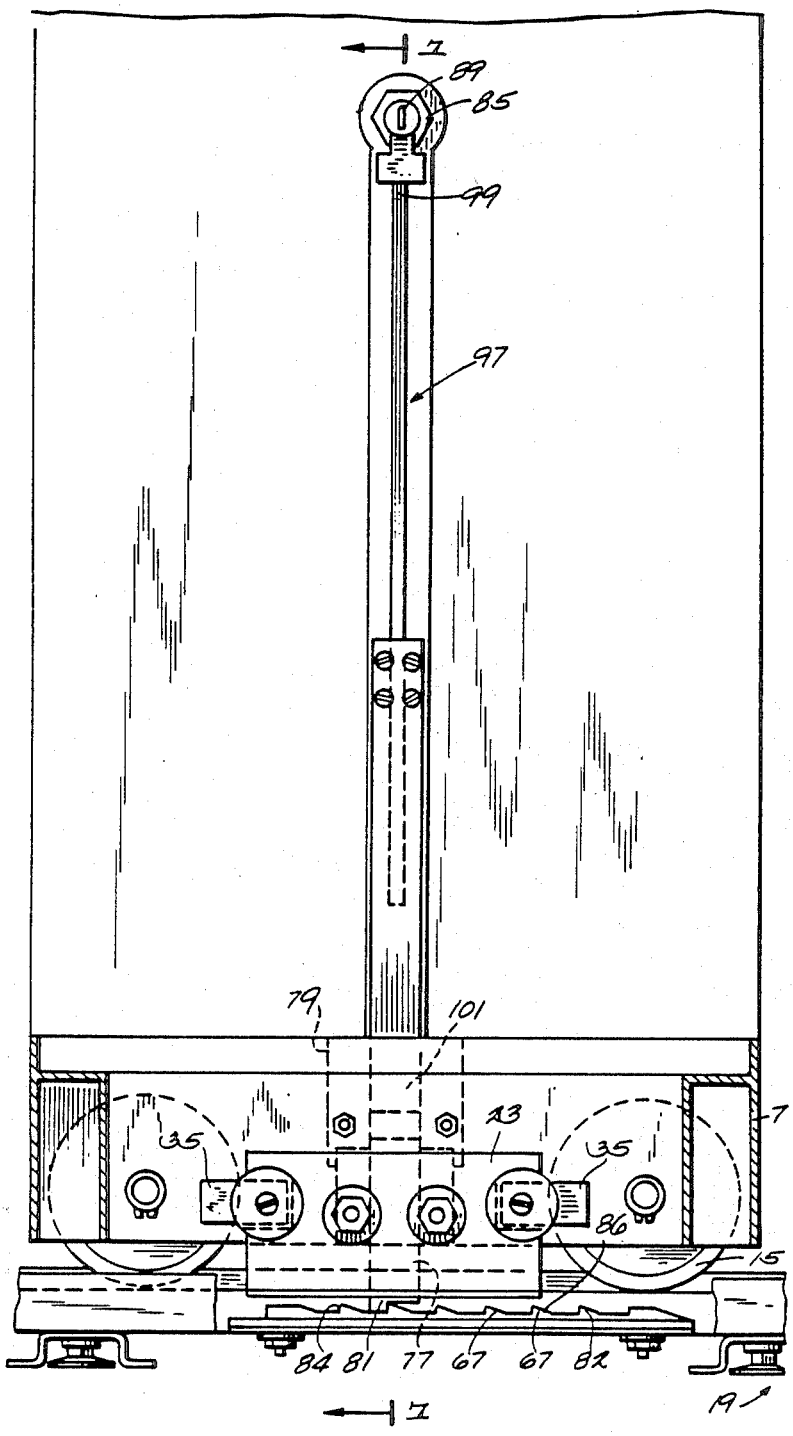
FIG. 6 is a view generally similar to FIG. 2 but showing a modified embodiment of the present invention.
Figure 7:
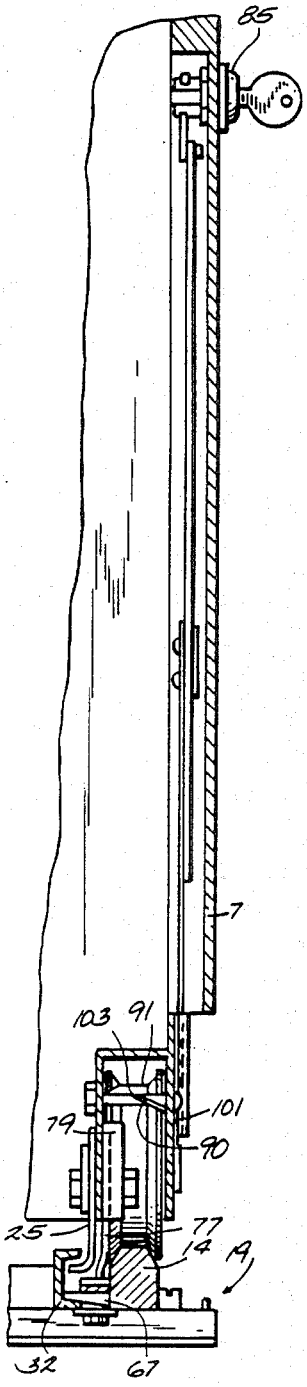
FIG. 7 is a cross-sectional view taken along lines 7—7 of FIG. 6.

In a modified embodiment of the present invention, the key lock 85 is placed at approximately waist level. Referring to FIGS. 6 and 7, a link bar 97 extends between the lock post 77 and the key lock. The link bar upper end 99 is fastened to the key lock lower pin 95. The link bar lower end 101 preferably includes an angular portion 103 that contacts the under surface 90 of the lock post bent-over upper end 91. Operating the key 89 to retract the pin 95 raises the lock post. Extending the pin 95 lowers the link bar, and gravity pulls the lock post into engagement with the rack 67.

Thus, it is apparent that there has been provided, in accordance with the invention, an anti tip system that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. In a mobile storage system having frame means for supporting at least two parallel rails on a building floor, and at least one movable carriage having a pair of wheels adapted to engage and move along each of the rails, an improved safety anti tip mechanism comprising:

a. a pair of channels, each channel having a pair of vertically spaced legs and being attached to the frame means adjacent a respective rail, each channel being positioned with the respective legs thereof in horizontal attitudes and extending oppositely from the legs of the other channel;

b. a pair of spaced tabs secured to the carriage between the wheels associated with each rail, wherein:

i. the tabs are formed with generally rectangular shapes having inner and outer ends; and ii. the tabs are secured to the carriage by welding the respective tab outer ends to the carriage;

c. a pair of allochiral plates, each plate interfitting with a pair of tabs, the plates having generally horizontal lower legs that ride within the channels adjacent the respective rails, wherein each plate is formed with notches that are received by the respective tab inner ends, so that the plates are guided on the carriages by the tabs; and d. means for securing the plates to the respective tabs, so that lurching of the carriage on the rails does not disengage the plates from the respective channels,

2. In a mobile storage system having frame means for supporting at least two parallel rails on a building floor, and at least one movable carriage having a pair of wheels adapted to engage and move along each of the rails, an improved safety anti tip mechanism comprising:

a. a pair of channels, each channel having a pair of vertically spaced legs and being attached to the frame means adjacent a respective rail, each channel being positioned with the respective legs thereof in horizontal attitudes and extending oppositely from the legs of the other channel;

b. a pair of spaced tabs secured to the carriage between the wheels associated with each rail, wherein the tabs and carriage are adapted to have the tabs secured to the carriage when the carriage is not engaged with the rails;

c. a pair of allochiral plates, each plate interfitting with a pair of tabs, the plates having generally horizontal lower legs that ride within the channels adjacent the respective rails, wherein the plates are adapted to be assembled and interfit with the respective pairs of tabs when the carriage is engaged with the rails, so that the carriage can be placed on the rails from above; and d. means for securing the plates to the respective tabs, so that lurching of the carriage on the rails does not disengage the plates from the respective channels,

3. In a mobile storage system having frame means for supporting at least two parallel rails on a building floor, and at least one movable carriage having a pair of wheels adapted to engage and move along each of the rails, an improved anti tip mechanism comprising:

a. a pair of channels, each channel having a pair of vertically spaced legs and being attached to the frame means adjacent a respective rail, each channel being positioned with the respective legs thereof in horizontal attitudes and extending oppositely from the legs of the other channel;

b. a pair of spaced tabs secured to the carriage between the wheels associated with each rail;

c. a pair of allochiral plates, each plate interfitting with a pair of tabs, the plates having generally horizontal lower legs that ride within the channels adjacent the respective rails;

d. means for securing the plates to the respective tabs, so that lurching of the carriage on the rails does not disengage the plates from the respective channels; and e. an adjustable stop releasably secured to an anti tip channel and in the path of an anti tip plate, so that carriage longitudinal movement along the rails is limited by the plate striking the adjustable stop.

4. The improved anti tip mechanism of claim 3 wherein the adjustable stop comprises:

a. a block positioned adjacent a rail and within the associated anti tip channel;

b. at least one washer located against the undersides of the rail and channel; and c. at least one screw associated with the washer and engaging the block to squeeze the channel between the block and washer when the screw is tightened and thereby secure the block to the channel.

5. The improved anti tip mechanism of claim 4 wherein:

a. there is a slot between the rail and associated channel; and b. the screw extends vertically through the slot, so that the screw may be loosened and slid within the slot with the block and washer to desired locations along the rail for retightening.

* * * * *